US005816235A

United States Patent [19]

Kim et al.

[11] Patent Number: 5,816,235

[45] Date of Patent: Oct. 6, 1998

[54] INFRARED GAS BURNER FOR GAS COOKERS

[75] Inventors: Hyung Dae Kim, Sungham-shi; Ung Tag Lim, Seoul; Tae Young Kim, Kunpo-shi; Chan Youl Park, Suwon-shi, all of Rep. of Korea

[73] Assignee: Tony Yang Magic Corporation, Seoul, Rep. of Korea

[21] Appl. No.: 868,700

[22] Filed: Jun. 4, 1997

[30] Foreign Application Priority Data

| | | | |
|---|---|---|---|
| Jun. 25, 1996 | [KR] | Rep. of Korea | 1996/17317(UM) U |
| Jun. 25, 1996 | [KR] | Rep. of Korea | 1996/17319(UM) U |
| Jun. 25, 1996 | [KR] | Rep. of Korea | 1996/17326(UM) U |
| Jun. 25, 1996 | [KR] | Rep. of Korea | 1996/17327(UM) U |
| Aug. 23, 1996 | [KR] | Rep. of Korea | 1996/25413(UM) U |
| Sep. 4, 1996 | [KR] | Rep. of Korea | 1996/38197 |
| Oct. 1, 1996 | [KR] | Rep. of Korea | 1996/32466(UM) U |

[51] Int. Cl.[6] ..... F24C 3/00

[52] U.S. Cl. ..... 126/39 H; 126/39 H; 126/39 J; 126/39 K

[58] Field of Search ..... 126/39 H, 39 N, 126/39 J, 39 K

[56] References Cited

U.S. PATENT DOCUMENTS

| | | | |
|---|---|---|---|
| 1,175,888 | 3/1916 | O'Dowd | 48/180.1 |
| 2,336,816 | 12/1943 | Thompson | 431/329 |
| 3,363,662 | 1/1968 | Curtis | 431/329 |
| 3,463,139 | 8/1969 | Hayashi et al. | 126/39 J |
| 3,941,117 | 3/1976 | Pei et al. | 126/39 J |
| 4,201,184 | 5/1980 | Scheidler et al. | 126/39 J |
| 5,024,209 | 6/1991 | Schaupert | 126/39 J |

*Primary Examiner*—Carroll B. Dority

*Attorney, Agent, or Firm*—Merchant, Gould, Smith, Edell, Welter & Schmidt

[57] ABSTRACT

An infrared gas burner for a gas cooker including a mixing tube arranged between a gas valve and a burner unit and adapted to mix gas supplied from the gas valve with air, a support member for supporting a ceramic plate within the burner unit in such a manner that the gas mixture emerging from the mixing tube passes through flame holes of the ceramic plate, a temperature control unit adapted to measure a temperature of flames generated by the burner unit, thereby controlling the amount of gas supplied to the burner unit based on the measured temperature, and a cover unit disposed over the burner unit and adapted to transfer infrared radiant heat and exhaust heat generated at the burner unit to a cooking pot laid thereon. The mixing tube is configured to mix gas with air in an optimum state for the combustion of the gas while uniformly distributing the gas mixture through flame holes of a ceramic plate, the transfer of heat to the body of a burner unit is reduced, thereby minimizing loss of heat. A metal net is disposed over the ceramic plate for achieving a complete gas combustion. Accordingly, it is possible to suppress the generation of noxious gas. A convenience in the cooking process is obtained by the temperature control unit. Accordingly, the infrared gas burner has an improved efficiency and reliability.

12 Claims, 14 Drawing Sheets

300
330
101
103
105
107
310
111
100
160
180
170
175
190
250
210
220
200
500
320
260
400
600
420
419
413
425
435
430
437
415
410
411
417
L1
L2
L3
L4
d2
d3
d4
4~8°

INFRARED GAS BURNER FOR GAS COOKERS

BACKGROUND OF THE INVENTION

1. Field of the Invention

The present invention relates to an infrared gas burner for fixed or portable gas cookers used for a variety of purposes, for example, home, business and industrial purposes, and more particularly to an infrared gas burner which includes a nozzle for injecting gas supplied through a gas valve, a mixing tube for mixing the injected gas with air and supporting means for supporting a ceramic plate in such a manner than the gas mixture emerging from the mixing tube passes through flame holes formed in the ceramic plate.

2. Description of the Prior Art

Generally, such an infrared gas burner is a burner used for gas cookers and developed to utilize a radiation of infrared rays (rays of radiant light). In this infrared gas burner, necessary air for the combustion of gas is sucked into a flow of the gas as the gas is injected. The resultant gas mixture is burned on a ceramic plate included in the infrared gas burner.

Referring to FIG. 16, a conventional infrared gas burner, which has been typically used, is illustrated. As shown in FIG. 16, the infrared gas burner includes a burner body 1 provided at its front wall with a knob 3. A gas valve unit 5 is operatively connected to the knob 3. The gas valve unit 5 communicates at one end thereof with a gas supply pipe 7 and at the other end thereof with a connecting hose 9. A burner unit 10 is fixedly mounted in the interior of the burner body 1. The burner unit 10 has a venturi pipe 17 connected to the connecting hose 9. The knob 3 serves to adjust the gas value unit 5, thereby adjusting the amount of gas supplied from the gas supply pipe 7 to the burner unit 10.

The burner unit 10 is also provided with a support member 11 which extends upwardly from the upper portion of the burner unit 10. The support member 11 serves to support a ceramic plate 20 on the lower end thereof. The ceramic plate 20 is provided with a plurality of flame holes 21. The burner unit 10 is in close contact with an upper plate 30 of the burner body 1 at its upper end. An exhaust passage 50 is also provided which communicates at one end thereof with the burner unit 10. The other end of the exhaust passage 50 is open to the atmosphere.

A packing 13, which is a thermal insulator made of glass fibers, is fitted around the peripheral surface of the ceramic plate 20. The packing 13 is laid on the lower end of the support member 11 while being interposed between the inner peripheral surface of the support member 11 and the outer peripheral surface of the ceramic plate 20, thereby firmly supporting the ceramic plate 20.

When the knob 3 rotates to open the gas valve unit 5, gas from the gas pipe 7 is introduced into the burner unit 10 via the gas valve unit 5, connecting hose 9 and venturi pipe 17. The gas introduced in the burner unit 10 then passes through the flame holes 21 of the ceramic plate 20 and reaches a space defined between the ceramic plate 20 and the upper plate 30 of the burner body 1. In the space, the gas is ignited by an ignition unit (not shown).

Flames on the upper surface of the ceramic plate 20 heat the ceramic plate 20, thereby generating radiant heat from the ceramic plate 20. By this radiant heat, the upper plate 30 disposed over the ceramic plate 20 is heated, thereby heating a cooking pot 40 laid thereon. Thus, a desired cooking process is achieved.

In such a conventional infrared gas burner having the above-mentioned construction, however, it is difficult to obtain a well mixed gas and air mixture because its mixing tube has a venturi shape having a gradually reduced and increased cross section or a cylindrical shape having a uniform cross section. Furthermore, the gas mixture flows at a high rate. As a result, the gas mixture is non-uniformly distributed to the flame holes 21 of the ceramic plate 20. This results in a poor gas combustion and a generation of a large amount of noxious gas. The conventional infrared gas burner also involves a degradation in thermal efficiency because it is provided with no means for preventing loss of infrared rays emitted from the ceramic plate 20.

As mentioned above, the ceramic plate 20 is supported within the burner unit 10 by means of the support member 11 and packing 13. Since the packing 13 is in close contact with the burner unit 10, the ceramic plate 20 heats the packing 13 and the body of the burner unit 10. As a result, an external loss of heat occurs easily.

The above-mentioned gas burner is provided with no temperature control means. As a result, the burner unit 10 may be over-heated after being used for a long period. In this case, the food being cooked may get burned or scorched. Such a phenomenon occurs frequently.

Furthermore, exhaust heat is externally discharged from the burner without being used to heat the cooking pot 40 as exhaust gas is externally discharged. This results in a loss of heat, thereby increasing the consumption of gas. Consequently, the conventional infrared gas burner involves a degradation in thermal efficiency and reliability.

SUMMARY OF THE INVENTION

Therefore, an object of the invention is to solve the above-mentioned problems involved in the prior art and to provide an infrared gas burner for a gas cooker including a mixing tube configured to mix gas with air in an optimum state for the combustion of the gas while uniformly distributing the gas mixture through flame holes of a ceramic plate, a ceramic plate supporting means providing a double air layer capable of reducing the transfer of heat to the body of a burner unit, thereby minimizing loss of heat, and a metal net disposed over the ceramic plate and adapted to allow an unburned portion of gas to be burned again, thereby suppressing the generation of noxious gas.

Another object of the invention is to provide an infrared gas burner for a gas cooker capable of adjusting the temperature of flames generated by a burner unit to a temperature desired by the user, thereby providing a convenience in the cooking process while achieving a minimum gas consumption and a high combustion efficiency when the burner unit is used for a long period.

Another object of the invention is to provide an infrared gas burner for a gas cooker capable of rapidly discharging exhaust gas generated during the operation of the burner and transferring the heat of the discharged exhaust gas to a cooking pot in such a manner that the heating speed of the cooking pot increases, thereby achieving an improvement in thermal efficiency.

In accordance with the present invention, these objects are accomplished by providing an infrared gas burner for a gas cooker comprising a burner body, a burner unit adapted to generate flames from gas supplied from a gas source and provided with a ceramic plate having a plurality of flame holes, a gas valve connected between the gas source and the burner unit and adapted to adjust the amount of gas supplied from the gas source to the burner unit, and a knob attached to the burner body and adapted to control the gas valve, further comprising: a mixing tube arranged between the gas valve and the burner unit and adapted to mix gas supplied from the gas valve with air; supporting means for supporting the ceramic plate within the burner unit in such a manner that the gas mixture emerging from the mixing tube passes through the flame holes of the ceramic plate; a temperature control unit adapted to measure a temperature of flames generated when the gas mixture passing through the ceramic plate is ignited by an ignition unit, thereby controlling the amount of gas supplied to the burner unit based on the measured temperature; and a cover unit disposed over the burner unit and adapted to transfer infrared radiant heat and exhaust heat generated at the burner unit to a cooking pot laid thereon.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Figures 1A, 1B, 1C:
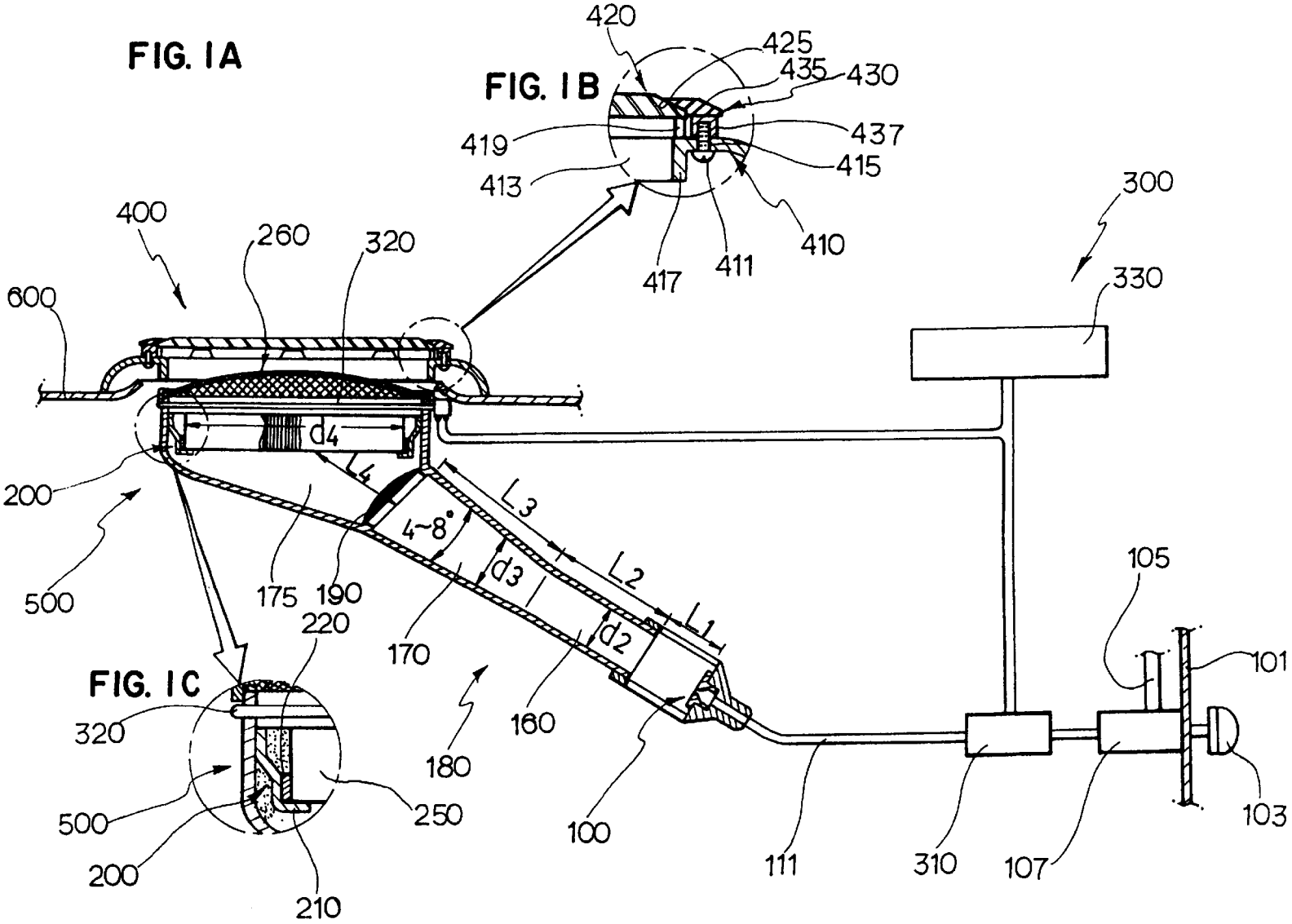
FIG. 1 is a sectional view schematically illustrating the construction of an infrared gas burner for gas cookers in accordance with the present invention.

FIG. 1 is a sectional view schematically illustrating the construction of an infrared gas burner for gas cookers in accordance with the present invention.

As shown in FIG. 1, the infrared gas burner includes a burner body 101 provided at its front wall with a knob 103. A first gas valve 107 is mounted to the front wall of the burner body 101 in the interior of the burner body 101 in such a manner that it is operatively connected to the knob 103. The first gas valve 107 communicates at one end thereof with a gas supply pipe 105. A second gas valve 310 is connected to the other end of the first gas valve 107. The second gas valve 310 constitutes a part of a temperature control unit 300. The second gas valve 310 is also connected to a nozzle 100. A burner unit 500 is fixedly mounted in the interior of the burner body 101. The burner unit 500 is connected to the nozzle 100. The knob 103 serves to adjust the first gas valve 107, thereby adjusting the amount of gas supplied from the gas supply pipe 105 to the burner unit 500.

Figure 2:
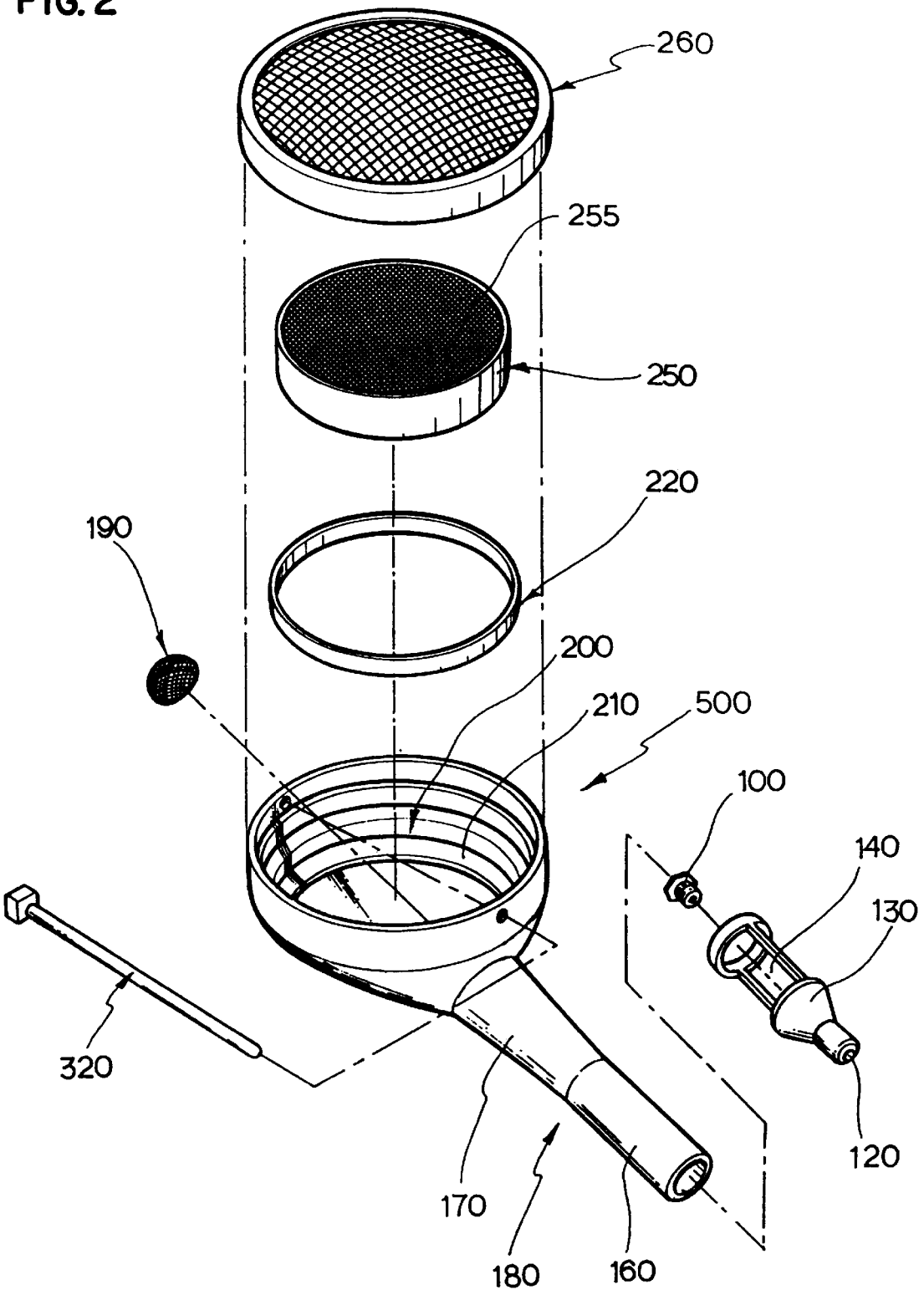
FIG. 2 is an exploded perspective view illustrating essential portions of the infrared gas burner shown in FIG. 1.
Figure 3A:
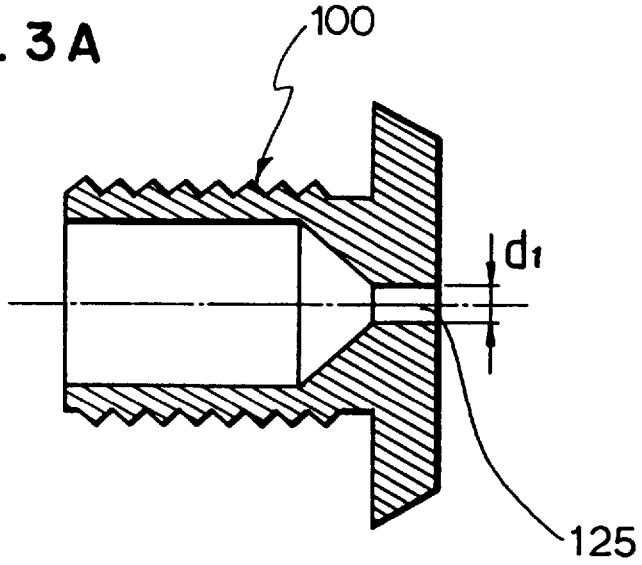
FIG. 3A is a sectional view illustrating a nozzle according to an embodiment of the present invention.

The infrared gas burner also includes a configuration arranged between the second gas valve 310 and burner unit 500 to feed gas from the gas supply pipe 105 to the burner unit 500. This configuration will now be described in conjunction with FIGS. 2 and 3. That is, the infrared gas burner includes an injection means for injecting gas emerging from the second gas valve 310 toward the burner unit 500, a mixing means 160 for mixing the gas injected from the injection means with air, and a diffusion means 170 for diffusing the gas mixture emerging from the mixing means 160. The infrared gas burner also includes a baffle 190 for uniformly distributing the gas mixture emerging from the diffusion means 170, a ceramic plate 250 for burning the gas mixture distributed from the baffle 190, a metal net 260 for re-burning a unburned portion of the gas mixture, and a cover unit 400 for transferring heat generated from the ceramic plate 250 to a cooking pot.

The injection means, which serves to inject gas supplied from the second gas valve 310, comprises an elbow 130 having a gas inlet passage 120. The gas inlet passage 120 communicates at one end thereof with the second gas valve 310 via a connecting hose 111. The nozzle 100 is mounted to the elbow 130 at the other end of the gas inlet passage 120. The elbow 130 is also provided with an air introducing portion 140 extending from the nozzle 100 by a desired length.

The mixing means 160 and diffusion means 170 comprise a mixing tube 180 fitted at one end thereof around the end of the elbow 130 disposed away from the nozzle 100. The mixing tube 180 has a uniform diameter portion extending from the end fitted around the elbow 130 by a length sufficient to feed gas introduced therein without any dispersion of the gas. The uniform diameter portion of the mixing tube 180 constitutes the mixing means 160. The mixing tube 180 also has a tapered portion extending from the uniform diameter portion to the vicinity of the ceramic plate 250 while gradually increasing its diameter. The tapered portion of the mixing tube 180 constitutes the diffusion means 170. The mixing tube 180 also has a flared portion extending from the tapered portion. The flared portion of the mixing tube 180 defines a diffusion space 175 therein. The flared portion of the mixing tube 180 also constitutes an upper body portion of the burner unit 500.

The baffle 190 is arranged at the end of the diffusion means 170 disposed toward the ceramic plate 250. The gas emerging from the diffusion means 170 is uniformly dispersed while passing through the baffle 190. Accordingly, a diffusion of gas is carried out in the diffusion space 175 defined over the baffle 190.

A support member 200 is fitted in the upper body portion of the burner unit 500 which is constituted by the flared portion of the mixing tube 180. The support member 200 serves to support the ceramic plate 250 in the upper body portion of the burner unit 500.

Preferably, the air introducing portion 140 of the elbow 130 has a length L1 corresponding to 30 to 60 times the diameter d1 (FIG. 3A) of the nozzle 100. The uniform diameter portion of the mixing tube 180 constituting the mixing means 160 has a length L2 corresponding to 1 to 3 times the diameter of the same portion.

Figure 3B:
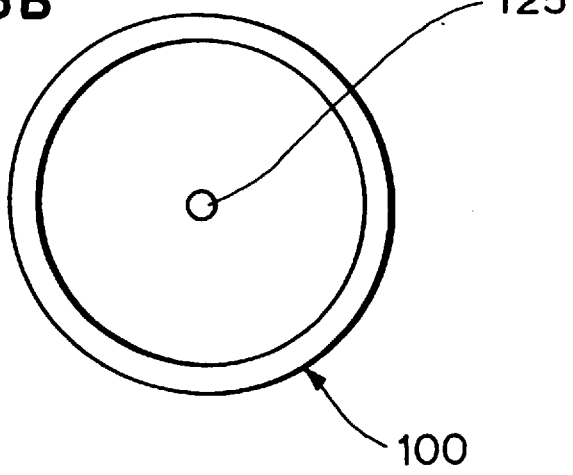
FIG. 3B is a side view illustrating the nozzle of FIG. 3A.
Figure 4A:
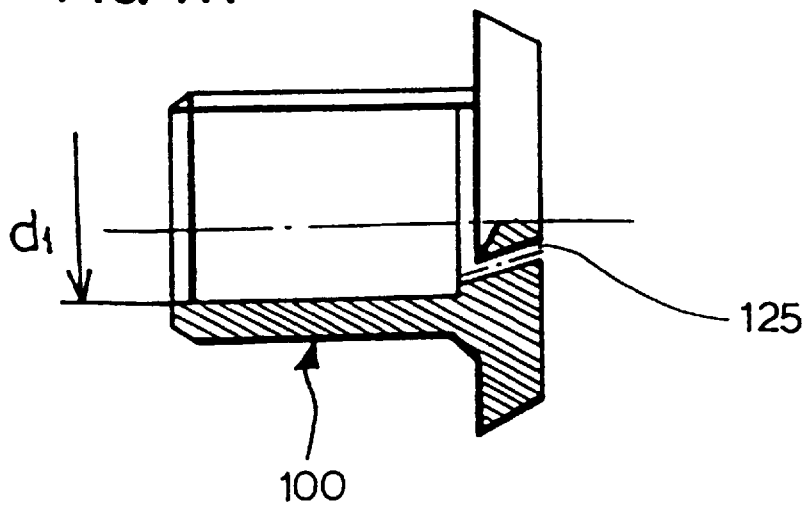
FIG. 4A is a sectional view illustrating a nozzle according to another embodiment of the present invention.
Figure 4B:
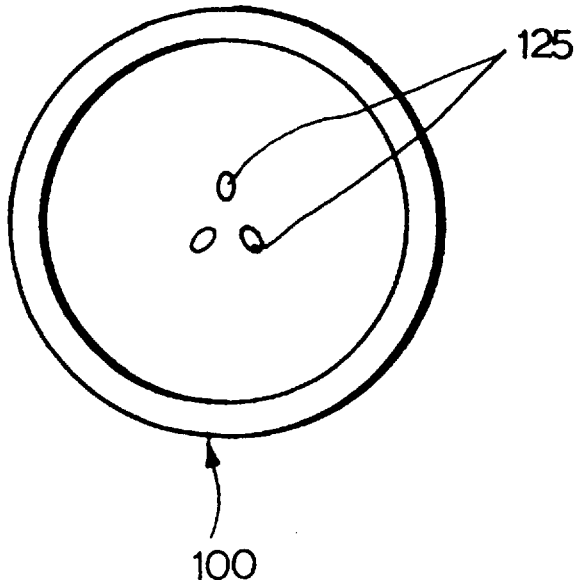
FIG. 4B is a side view illustrating the nozzle of FIG. 4A.

The nozzle 100 is provided with one or more gas injection ports 125, as shown in FIG. 3B or 4B. Where the nozzle 100 has a plurality of gas injection ports 125, the axes of those gas injection ports 125 extends angularly or perpendicularly with respect to the axis of the nozzle 100, as shown in FIG. 4A. The gas injection ports 125 may also be formed in such a manner that they extend tangentially with respect to the periphery of the nozzle 100. This will be described hereinafter.

The tapered portion of the mixing tube 180 constituting the diffusion means 170 has a tapered angle of 4° to 8°. The baffle 190, which defines the bottom of the diffusion space 175, comprises a dome-like metal net.

As shown in FIG. 1, the mixing tube 180, in which gas mixed with air is fed, extends upwardly while forming an angle with respect to a horizontal plane. The angle of the mixing tube 180 may be optionally determined within a range from 0° to 90° in so far as the function of the mixing tube 180 is obtained.

The support member 200 serves to support the ceramic plate 250 in such a manner that the gas guided by the mixing tube 180 passes through flame holes 255 formed in the ceramic plate 250. As shown in FIG. 1, the support member 200 has an annular construction including an upper portion welded to the inner peripheral surface of the upper body portion of the burner unit 500, an inwardly bent portion downwardly extending from the upper portion, and a lower portion downwardly extending from the inwardly bent portion and having an inner flange 210 on which the ceramic plate 250 is laid. A packing 220, which is a thermal insulator made of glass fibers, is interposed between the inner peripheral surface of the support member 200 and the outer peripheral surface of the ceramic plate 250.

As shown in FIG. 1, the second gas valve 310, which is included in the temperature control unit 300, is connected to the first gas valve 107 and to the nozzle 100 via the connecting hose 111. The temperature control unit 300 also includes a temperature sensing bar 320 disposed over the ceramic plate 250 seated on the support member 200. The temperature sensing bar 320 serves to sense the temperature of flames generated when gas passing through the ceramic plate 250 is burned by the function of an ignition unit so that the temperature control unit 300 controls the amount of gas supplied to the burner unit 500 based on the sensed temperature. The temperature sensing bar 320 is fixedly mounted to the upper end of the burner unit 500 in such a manner that it is upwardly spaced from the upper surface of the ceramic plate 250 by a desired distance while horizontally traversing the ceramic plate 250. The temperature control unit 300 also includes a temperature controller 330 connected to both the second gas valve 310 and temperature sensing bar 320. The temperature controller serves to receive the temperature sensed by the temperature sensing bar 320, thereby controlling the second gas valve 310 based on the received temperature.

The metal net 260 is disposed over the temperature sensing bar 320 while being spaced from the temperature sensing bar 320 by a desired distance. The metal net 260 is exposed through an opening formed at an upper plate 600 included in the burner body 101. The cover unit 400, which serves to transfer heat generated from the burner unit 500 to a cooking pot (not shown) laid thereon, is laid on the upper plate 600 around the opening.

Figure 10:
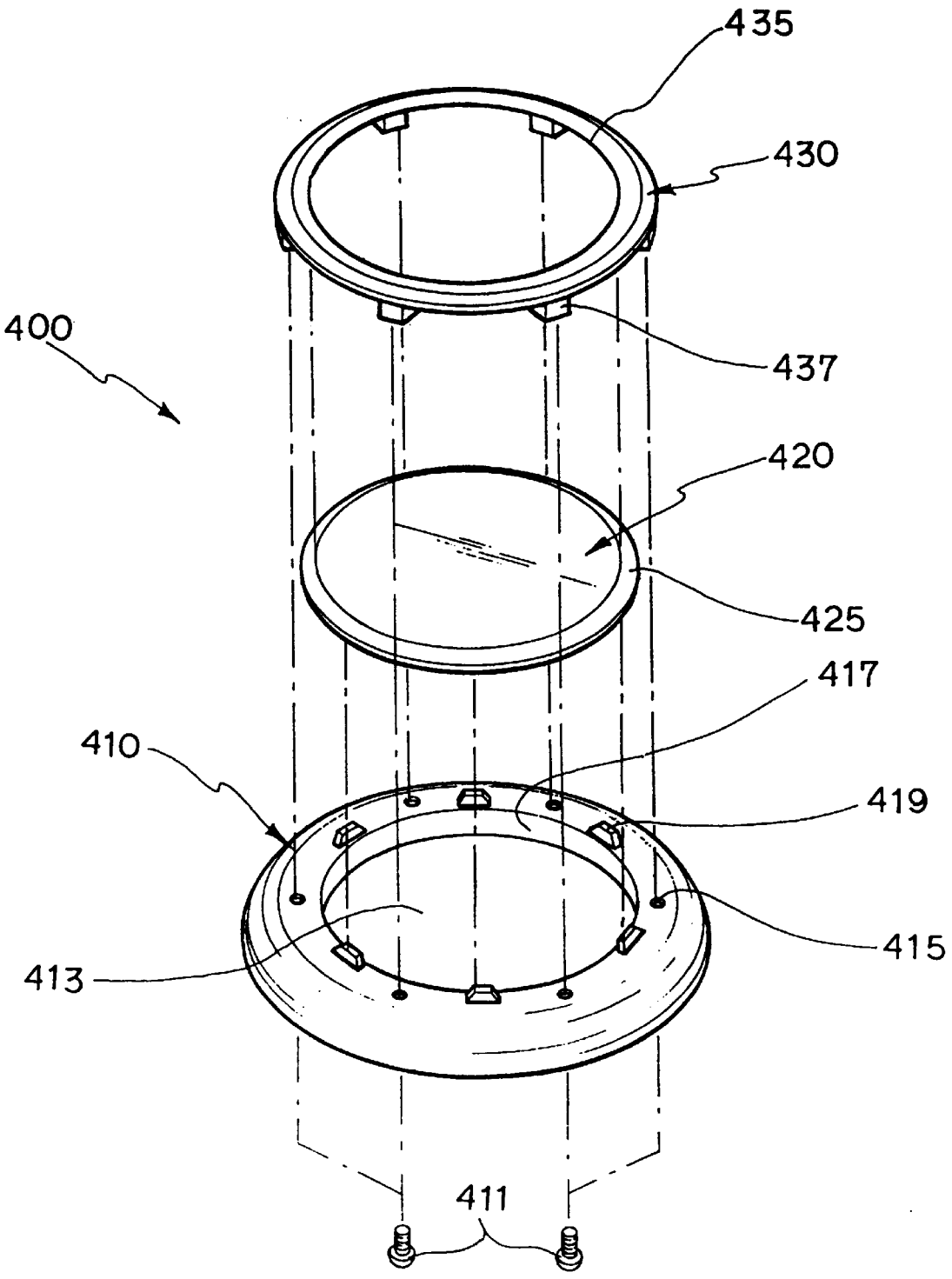
FIG. 10 is an exploded perspective view illustrating a cover unit configured in accordance with the present invention.
Figure 11:
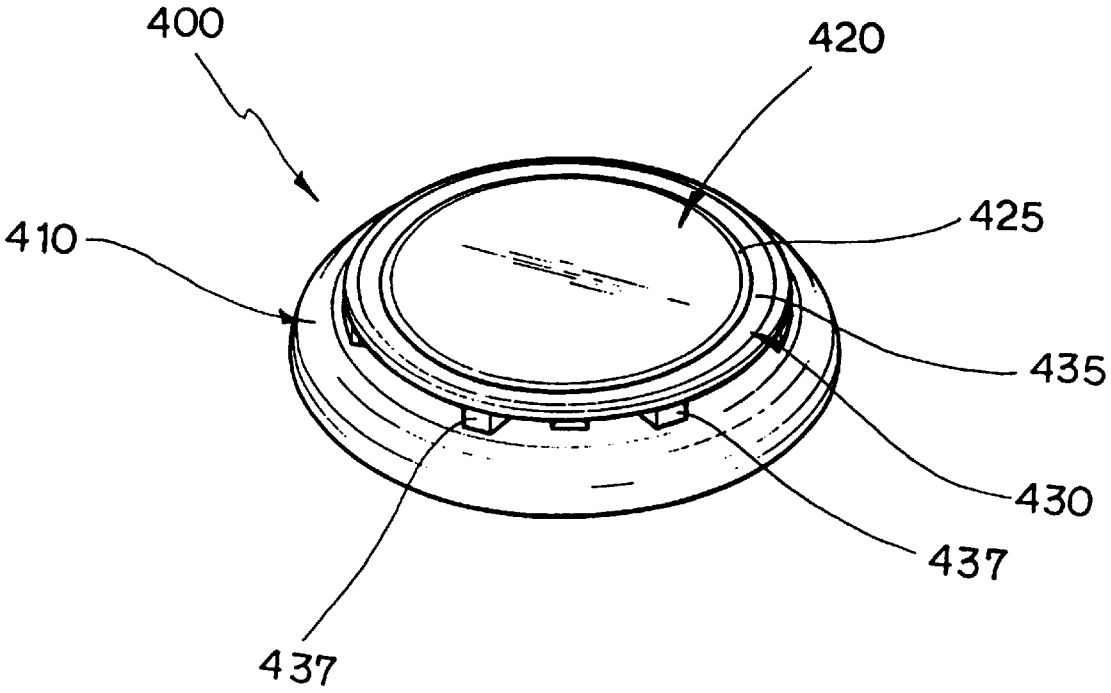
FIG. 11 is a perspective view illustrating a coupled condition of the cover unit shown in FIG. 10.

The cover unit 400 has a construction shown in FIGS. 1, 10 and 11. That is, the cover unit 400 includes a cover ring 410, a heating plate 420 and a holder 430 which are coupled together by means of set screws 411. The heating plate 420 may be made of reinforced glass, copper, brass or other appropriate material.

The cover ring 410 has a flame opening 413 defined by its inner peripheral surface. At least three support protrusions 419 are formed on the upper surface of the cover ring 410 in such a manner that they are uniformly spaced. A coupling hole 415 is also provided at the cover ring 410 between adjacent support protrusions 419. The coupling holes 415 are arranged in a circle having a diameter larger than that of a circle in which the support protrusions 419 are arranged. The circles are concentric with the flame opening 413.

The inner peripheral surface of the cover ring 410, which defines the flame opening 413, provides a guide surface for guiding heat from exhaust gas generated during the combustion of gas in the burner unit 500.

The heating plate 420 has the same diameter as the circle in which the support protrusions 419 of the cover ring 410 are arranged. This heating plate 420 is seated on the support protrusions 419 of the cover ring 410. The heating plate 420 is also provided with an inclined surface 425 at the peripheral edge portion of its upper surface.

The holder 430 is provided at the inner portion of its upper surface with an engaging rim 435 having a diameter identical to or slightly larger than that of the inclined surface 425. The engaging rim 435 has an inclined surface having the same inclination as the inclined surface 425.

The holder 430 is also provided at its lower surface with coupling protrusions 437 corresponding in number to the coupling holes 415 of the cover ring 410. A set screw 411, which extends through each coupling hole 415 of the cover ring 410, is threadedly coupled to the coupling protrusion 437 of the holder 430 corresponding to the coupling hole 415. By this coupling, the holder 430 is coupled to the cover ring 410 in such a manner that they are in contact with each other while fixing the heating plate 420 interposed therebetween.

Now, the infrared gas burner having the above-mentioned arrangement according to the present invention will be described.

When the knob 103 is rotated to open the first gas valve 107, gas from the gas supply pipe 105 is introduced into the elbow 130 via the first gas valve 107, second gas valve 310 and gas inlet passage 120 of the elbow 130.

The introduced gas is injected at a certain pressure into the air introducing portion 140 of the elbow 130 by the nozzle 100 which is threadedly coupled to the downstream end of the gas inlet passage 120. In such a manner, the effect of the injection means according to the present invention is obtained.

As mentioned above, the nozzle 100 may be provided with at least three gas injection ports 125, if necessary. In this case, each of the gas injection ports 125 has an axis extending angularly with respect to the axis of the nozzle 100. By such a configuration, it is possible to mix the gas from the gas injection ports 125 with air introduced in the air introducing portion 140.

Figure 5A:
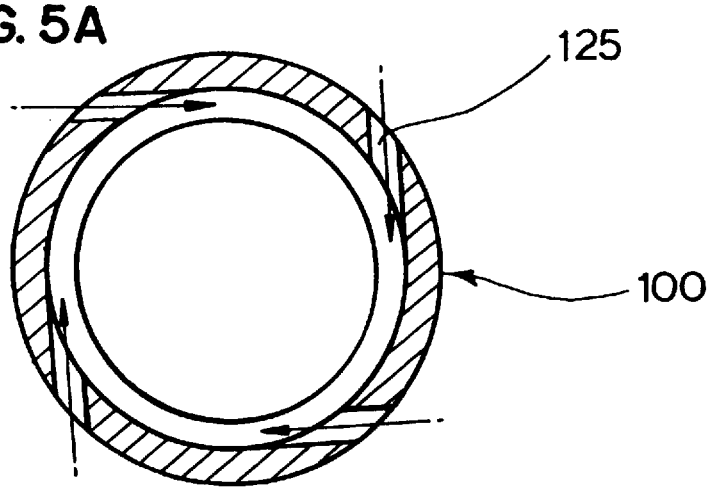
FIG. 5A is a sectional view illustrating a nozzle according to another embodiment of the present invention.
Figure 5B:
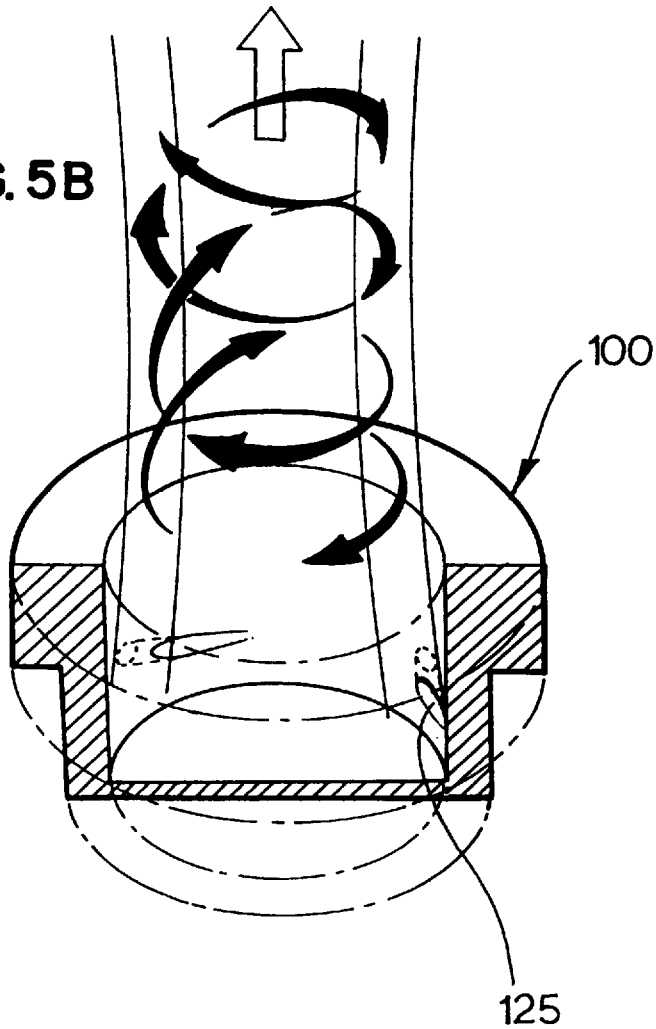
FIG. 5B is a side view illustrating a flow of gas injected from the nozzle of FIG. 5A.

FIGS. 5A and 5B illustrate a nozzle according to another embodiment of the present invention. FIG. 5A is a sectional view of the nozzle whereas FIG. 5B is a partially-broken perspective view schematically showing a flow of gas generated by the nozzle. In this case, the nozzle 100 has gas injection ports 125 each having an axis extending tangentially with respect to the periphery of the nozzle 100 while being perpendicular to the axis of the nozzle 100. By such a configuration, a flow of gas is injected from the nozzle while whirling. Accordingly, the injected gas can be well mixed with air. As a result, it is possible to obtain a good combustion state and a large quantity of heat even at a low gas pressure. In particular, such a configuration can be advantageously used in the case in which a large quantity of heat is required.

The gas injected from the gas injection ports 125 of the nozzle 100 is introduced in the air introducing portion 140 of the elbow 130, which extends from the nozzle 100 by a desired length, while maintaining its injection state.

As the injected gas flows in the air introducing portion 140 of the elbow 130, air from the atmosphere is sucked into the gas flow so that it is injected into the uniform diameter portion of the mixing tube 180, namely, the mixing means 160, along with the gas flow. Thus, a gas mixture is obtained.

The length L1 of the air introducing portion 140 should correspond to 30 to 60 times the diameter d1 of the nozzle 100. Where the length L1 is more than 60 times the nozzle diameter d1, the quantity of sucked air is excessively large, thereby resulting in an increased production of carbon monoxide (CO). As a result, a flame surge phenomenon occurs which results in a degradation in combustion efficiency. Where the length L1 is less than 30 times the nozzle diameter d1, the quantity of sucked air is insufficient, thereby resulting in a degradation in combustion efficiency.

The uniform diameter portion of the mixing tube 180, namely, the mixing means 160, has a uniform diameter and a desired length so as to allow the gas mixture from flowing in the mixing means 160 without any dispersion. The diameter d2 and length L2 of the mixing means 160 may be appropriately determined in accordance with the kind of gas and the gas injection rate. Preferably, the diameter d2 of the mixing means 160 corresponds to 14 to 24 times the nozzle diameter d1. Preferably, the length L2 of the mixing means 160 corresponds to 1 to 3 times the diameter d2 of the mixing means 160.

Where the length L2 is less than the diameter d2, the mixing of gas with air is insufficiently achieved. Where the length L2 is more than 3 times the diameter d2, an increase in flow resistance occurs.

The gas mixture emerging from the mixing means 160 defined in the mixing tube 180 is introduced in the diffusion means 170 which is defined by the tapered portion of the mixing tube 180 and aligned with the mixing means 160, so that it is diffused. The diffusion means 170 has a diameter gradually increasing from one end thereof connected to the mixing means 160 to the other end thereof disposed near the ceramic plate 250. By such a construction, the gas mixture is naturally diffused as it passes through the diffusion means 170.

The diffusion means 170 has a medium diameter d3 corresponding to about 1.5 times the diameter d2 of the mixing means 160 and a length L3 corresponding to 1.5 to 3.5 times the diameter d3. Where the length L3 is less than 1.5 times the diameter d3 an increased production of carbon monoxide and a degradation in combustion efficiency occur. Where the length L3 is more than 3.5 times the diameter d3, an increase in flow resistance occurs.

It is preferred that the tapered angle of the diffusion means 170 range from 4° to 8°, taking into consideration the relation between the diameter d3 and length L3 of the diffusion means 170. As mentioned above, the mixing tube 180 extends upwardly while forming an angle with respect to a horizontal plane. The angle of the mixing tube 180 may be optionally determined within a range from 0° to 90° so as to obtain an appropriate installation condition.

The diffused gas mixture emerging from the diffusion means 170 is further diffused into the diffusion space 175 defined by the flared portion of the mixing tube 180 while passing through the baffle 190 disposed at the upper end of the diffusion means 170. In accordance with such a diffusion in the diffusion space 175, the gas mixture is uniformly distributed throughout the ceramic plate 250. Finally, the gas mixture passes through the flame holes 255 of the ceramic plate 250 and is ignited by the ignition unit (not shown).

The diffusion space 175 has a distribution length L4 corresponding to 0.1 to 0.3 time the diameter d4 of the ceramic plate 250. Where the distribution length L4 is less than 0.1 times the diameter d4, an instable combustion occurs, thereby lowering the surface temperature of the ceramic plate 250. Where the distribution length L4 is more than 0.3 times the diameter d4, the burner unit 500 becomes bulky.

The baffle 190, which is configured by a dome-like metal net and arranged at the outlet of the diffusion means 170, serves to assist the diffusion of the gas mixture, thereby further stabilizing the combustion condition of the gas mixture.

The ceramic plate 250, which is disposed above the diffusion space 175, is stably supported at the upper body portion of the burner unit 500 by the support member 200. Accordingly, a stable heating power is obtained.

Gas emerging from the flame holes 255 of the ceramic plate 250 is ignited by the ignition unit (not shown). Flames on the upper surface of the ceramic plate 250 heat the ceramic plate 250, thereby generating radiant heat from the ceramic plate 250. By this radiant heat, the cover unit 400 disposed over the ceramic plate 250 is heated, thereby heating a cooking pot laid thereon. Thus, a desired cooking process is achieved.

As the ceramic plate 250 is heated, the packing 220, which is in contact with the ceramic plate 250, is also heated. As a result, the support member 200 is heated. At this time, air layers are also heated which exist in gaps defined between the upper body portion of the burner unit 500 and the ceramic plate 250.

The air layers serve to suppress the heat from the ceramic plate 250 to be transferred to the outside of the burner unit 500.

The metal net 260 is also heated by the heat generated by the ceramic plate 250, thereby re-burning an unburned portion of gas. Accordingly, the metal net 260 suppresses the generation of noxious gas and maximizes the heating of the cooking pot laid on the cover unit 400.

Figure 6:
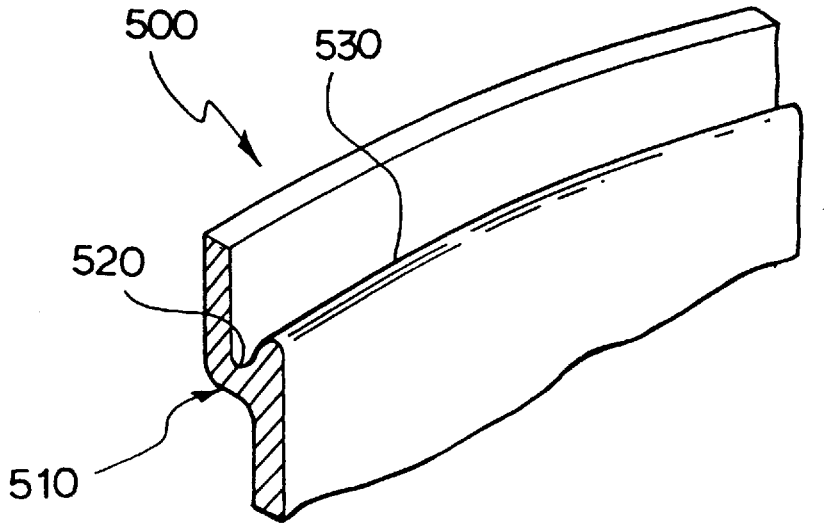
FIG. 6 is a perspective view partially illustrating a support member configured in accordance with another embodiment of the present invention.

Meanwhile, FIG. 6 is a perspective view partially illustrating a support member configured in accordance with another embodiment of the present invention. Since the function of the support member for supporting the ceramic plate in this embodiment is identical to that of the above-mentioned embodiment, its detailed description will be omitted. Only the characterized configuration of the support member will be described hereinafter.

In accordance with the embodiment of FIG. 6, a support member 510 is integrally formed with the upper body portion of the burner unit 500. The support member 510 is provided by bending the upper body portion of the burner unit in such a manner that a step is formed. The support member 510 has an annular protrusion 530 upwardly extending from the inner peripheral surface portion of the upper body portion of the burner unit 500 corresponding to the step. An annular groove 520 is defined around the annular protrusion 530. The packing 220 engages in the annular groove 520. The ceramic plate 250 is laid on the annular protrusion 530. In accordance with such a configuration of the support member 510, the ceramic plate 250 is in contact with the annular protrusion 530 and the inner peripheral surface of the burner unit 500 while being surrounded by the packing 220.

Flames generated at the flame holes 255 of the ceramic plate 250 supported by the support member 510 having the above-mentioned configuration heats the ceramic plate 250, thereby generating radiant heat from the ceramic plate 250. By this radiant heat, the cover unit 400 disposed over the ceramic plate 250 is heated, thereby heating a cooking pot laid thereon. Thus, a desired cooking process is achieved.

Since the area of the ceramic plate 250 contacting the annular protrusion 530 of the support member 510 is small, the heat transferred from the ceramic plate 250 to the outside of the burner unit 500 is reduced. Accordingly, it is possible to minimize loss of heat.

Figure 7:
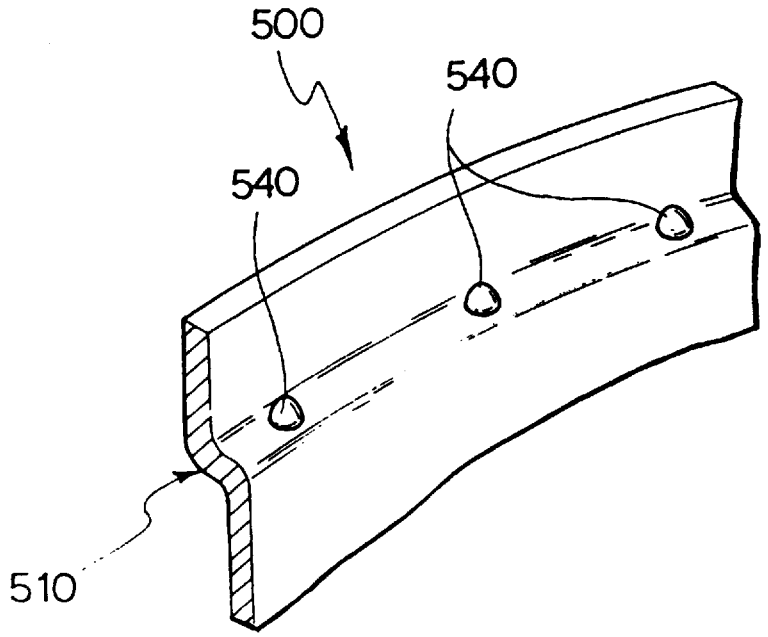
FIG. 7 is a perspective view partially illustrating a support member configured in accordance with another embodiment of the present invention.

On the other hand, FIG. 7 is a perspective view partially illustrating a support member configured in accordance with another embodiment of the present invention. Since the function of the support member for supporting the ceramic plate in this embodiment is identical to that of the embodiment of FIG. 1, its detailed description will be omitted. Only the characterized configuration of the support member will be described hereinafter.

In accordance with the embodiment of FIG. 7, a support member 510 is integrally formed with the upper body portion of the burner unit 500. The support member 510 is provided by bending the upper body portion of the burner unit in such a manner that a step is formed. The support member 510 has at least three protrusions 540 formed on the inner peripheral surface of the upper body portion of the burner unit 500 corresponding to the step. The ceramic plate 250 is laid at its edge portion on the protrusions 540 of the support member 510 while the packing 220 is interposed between the outer peripheral surface of the ceramic plate 250 and the inner peripheral surface of the burner unit 500. In accordance with such a configuration of the support member 510, the ceramic plate 250 is in contact with the protrusions 540 and the inner peripheral surface of the burner unit 500 while being surrounded by the packing 220.

Flames generated at the flame holes 255 of the ceramic plate 250 heat a cooking pot laid on the cover unit 400. Thus, a desired cooking process is achieved.

Since the area of the ceramic plate 250 contacting the annular protrusion 540 of the support member 510 is small, the heat transferred from the ceramic plate 250 to the outside of the burner unit 500 is reduced. Accordingly, it is possible to minimize loss of heat.

As mentioned above, the temperature control unit 300 serves to control the amount of gas supplied to the burner unit 500, thereby controlling the temperature of heat generated by the burner unit 500. By virtue of the temperature control unit 300, it is possible to control a cooking or heating temperature in accordance with the kind of food, such as deep-fried food, soup, panfried food or pot stew, to be cooked. A desired cooking or heating temperature is set in the temperature controller 330 of the temperature control unit 300 as the user manipulates the temperature controller 330. The temperature sensing bar 320 connected to the temperature controller 330 senses the temperature of flames generated when gas passing through the ceramic plate 250 is burned. The temperature sensing bar 320 sends the sensed temperature to the temperature controller 330. When the temperature controller 330 receives the sensed temperature, it compares the sensed temperature with the set temperature, thereby determining a difference between the sensed and set temperatures. Based on the determined temperature difference, the temperature controller 330 controls the second gas valve 310, thereby controlling the amount of gas supplied to the burner unit 500. Thus, a desired cooking or heating temperature is maintained. Accordingly, there is seldom an occasion that the food being cooked gets burned or scorched. In other words, an efficient cooking process is achieved.

Figure 8:
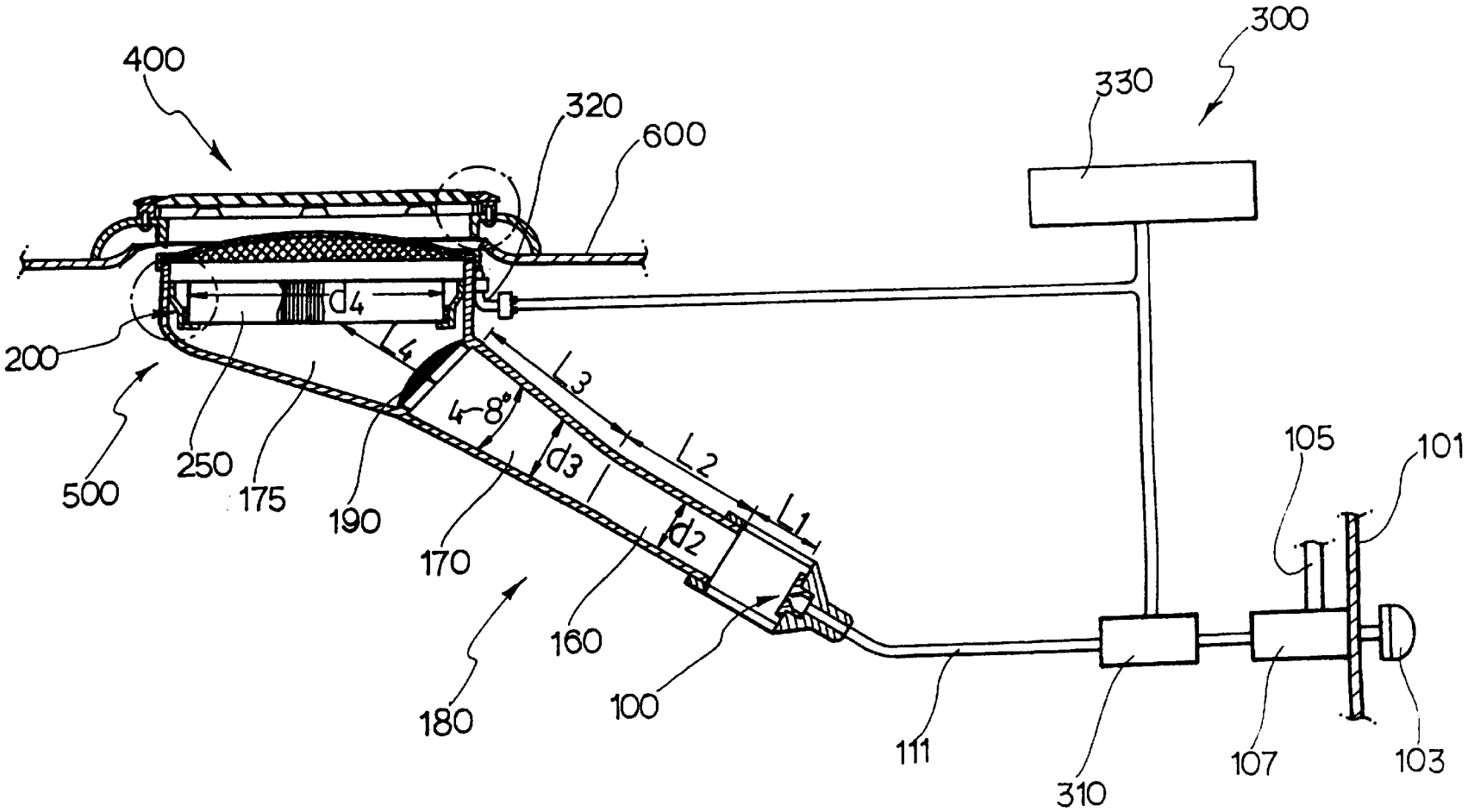
FIG. 8 is a sectional view schematically illustrating a temperature control unit configured in accordance with another embodiment of the present invention.

FIG. 8 illustrates another embodiment of the present invention using a temperature control unit having a configuration different from that of the embodiment of FIG. 1. In accordance with this embodiment, the temperature sensing bar 320 is attached to the outer peripheral surface of the upper body portion of the burner unit 500. Similarly to the temperature sensing bar in the embodiment of FIG. 1, this temperature sensing bar 320 senses the temperature of the ceramic plate 250 and sends it to the temperature controller 330. Based on the sensed temperature, the temperature controller 330 controls the second gas valve 310, thereby maintaining the temperature of flames at a desired temperature. Accordingly, there is seldom an occasion that the food being cooked gets burned or scorched. Thus, an efficient cooking process is achieved.

Figure 9:
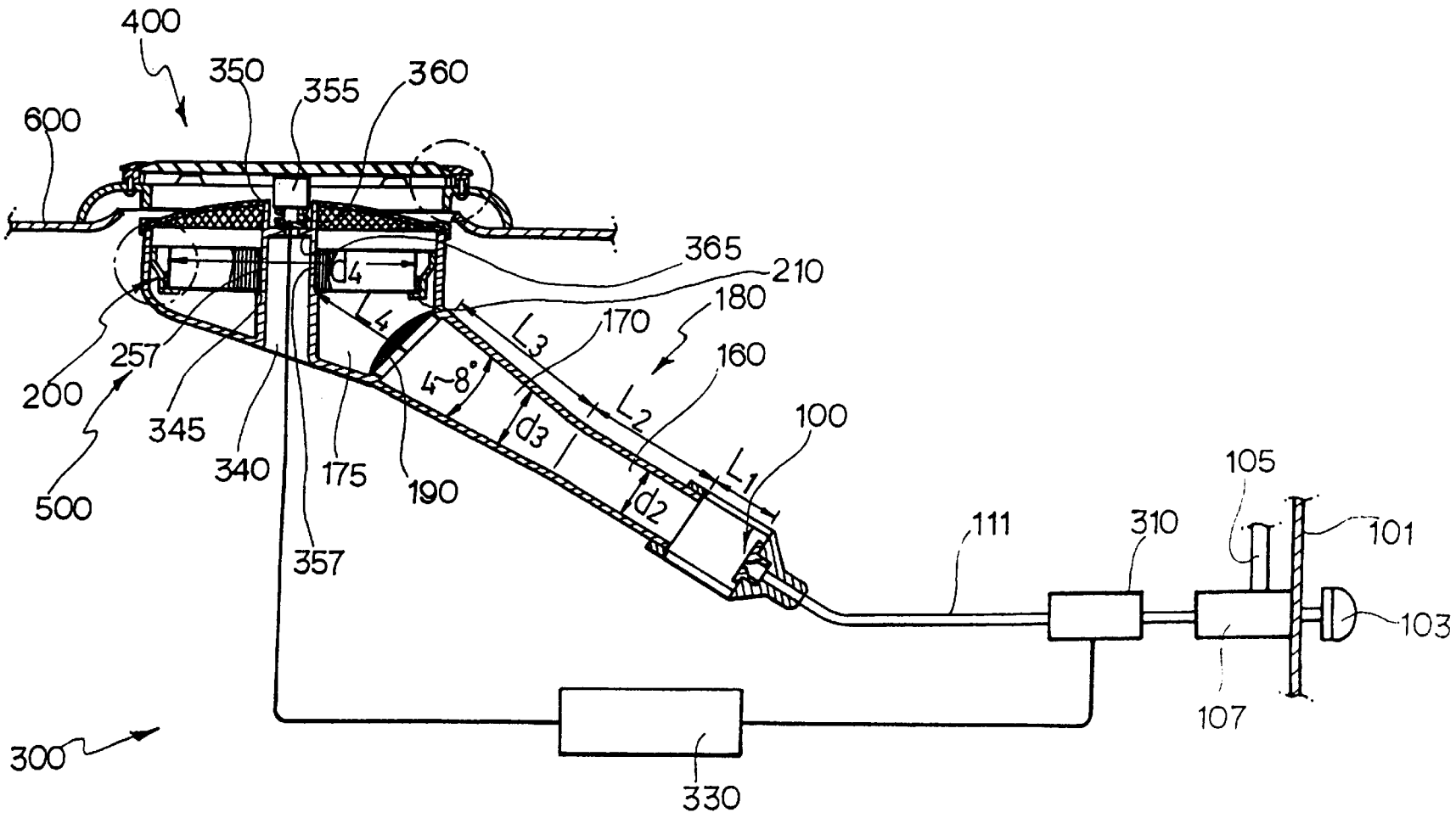
FIG. 9 is a sectional view schematically illustrating a temperature control unit configured in accordance with another embodiment of the present invention.

FIG. 9 illustrates an infrared gas burner in accordance with another embodiment of the present invention using a temperature control unit having a configuration different from those of the embodiments of FIGS. 1 and 8. In accordance with this embodiment, the temperature control unit 300 includes a temperature sensor 355 which is in contact with the lower surface of the heating plate 420 included in the cover unit 400 by the elastic force of a spring 360. The spring 360 is supported at its lower end by a spring seat 365.

In order to support the spring seat 365, a hollow central column 350 extends vertically from a portion of the burner body corresponding to the flared portion of the mixing tube 180. The spring seat 365 is integrally formed with the hollow central column 350 in the interior of the column. An annular step 345 is formed on the outer peripheral surface of the central column 350. The ceramic plate 250 has a central hole 357 so that it can be fitted around the central column 350. The ceramic plate 250 is supported at its inner peripheral edge on the annular step 345 of the central column 350 and at its outer peripheral edge on the inner flange 210 of the support member 200.

Similarly to the temperature control unit of the embodiment shown in FIG. 1 or FIG. 8, the temperature control unit of this embodiment senses the temperature of the heating plate 260 heated by the heat generated at the ceramic plate 250 and compares the sensed temperature with a temperature set by the user, thereby controlling the second gas valve 310 to maintain the temperature of flames generated by the burner unit 500 at a desired temperature.

Exhaust gas generated during the operation of the burner is rapidly discharged from the interior of the burner unit through gaps defined between the heating plate 420 seated on the support protrusions 419 of the cover ring 410 and the coupling protrusions 437 of the holder 430 while transferring its heat to the cooking pot (FIGS. 10, 11). Accordingly, it is possible to increase the heating speed of the cooking pot, thereby reducing the cooking time.

Figure 12:
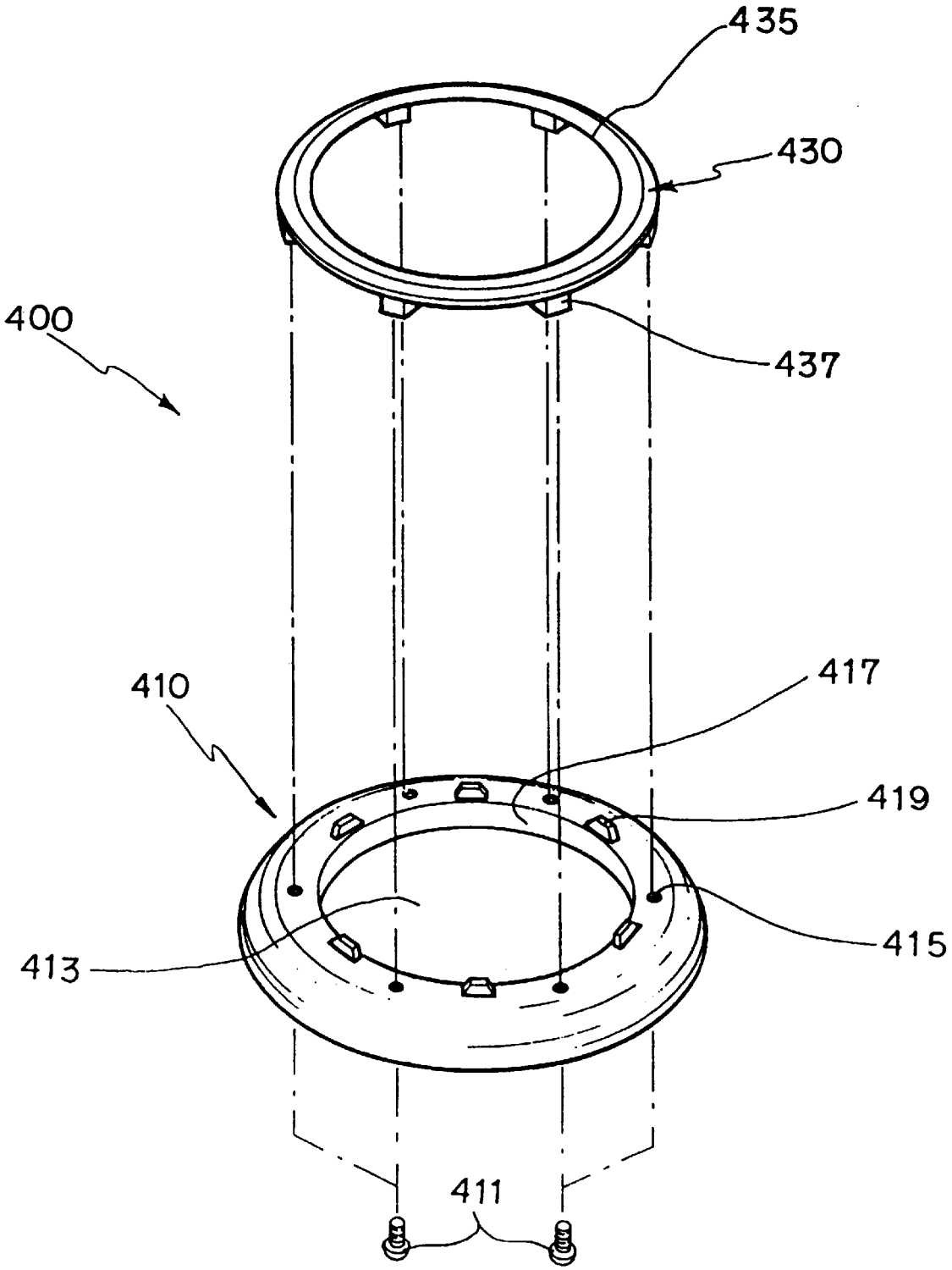
FIG. 12 is a perspective view illustrating the cover construction of FIG. 10 from which the heating plate is omitted.

FIG. 12 is a perspective view illustrating the cover unit from which the heating plate is omitted. Referring to FIG. 12, it can be understood that even when the heating plate 420, which is made of reinforced glass, copper or brass, can not be used due to its being broken or damaged resulting from a carelessness of the user, the burner unit can be normally used by coupling the holder 430 to the cover ring 410 by means of set screws 411 after removing the broken or damaged heating plate 420.

Figure 13:
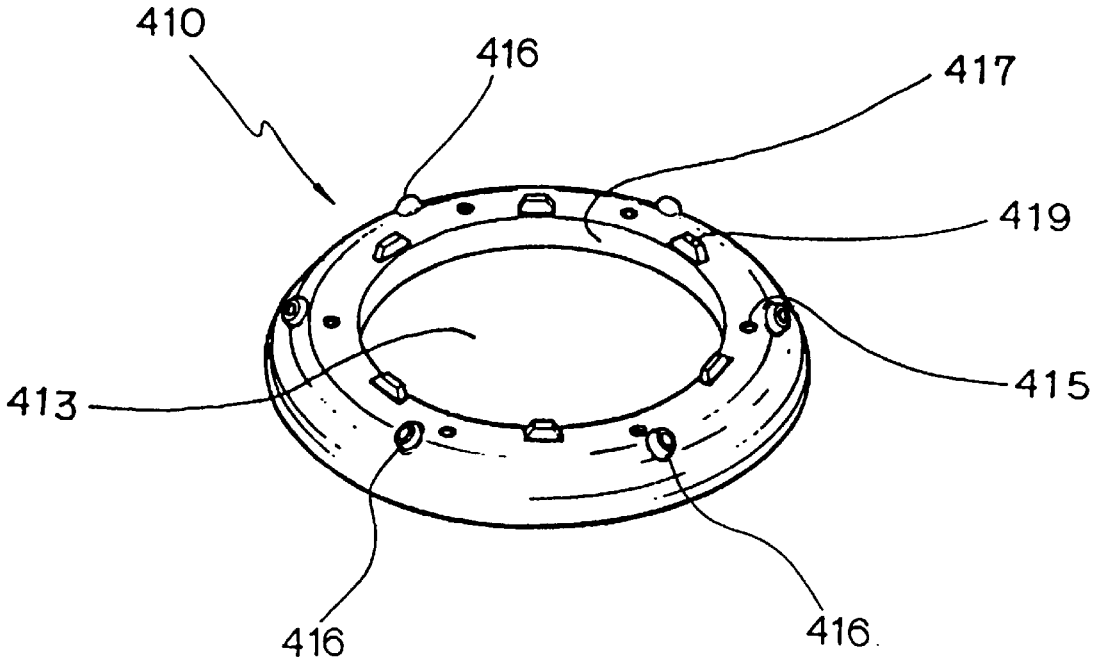
FIG. 13 is a perspective view illustrating a cover ring according to another embodiment of the present invention.

FIG. 13 is a perspective view illustrating a cover ring according to another embodiment of the present invention. In accordance with this embodiment, a plurality of exhaust nozzles 416 (at least two exhaust nozzles) are provided at the cover ring in such a manner that they are circumferentially arranged. The exhaust nozzles 416 serve to discharge unburned gas and infrared radiant heat toward a cooking pot disposed over the cover ring. In this case, it is possible to heat a cooking pot, without using the heating plate 420 and holder 430, under the condition in which the cooking pot is directly laid on the cover ring. Accordingly, a convenience in use is obtained.

Figure 14:
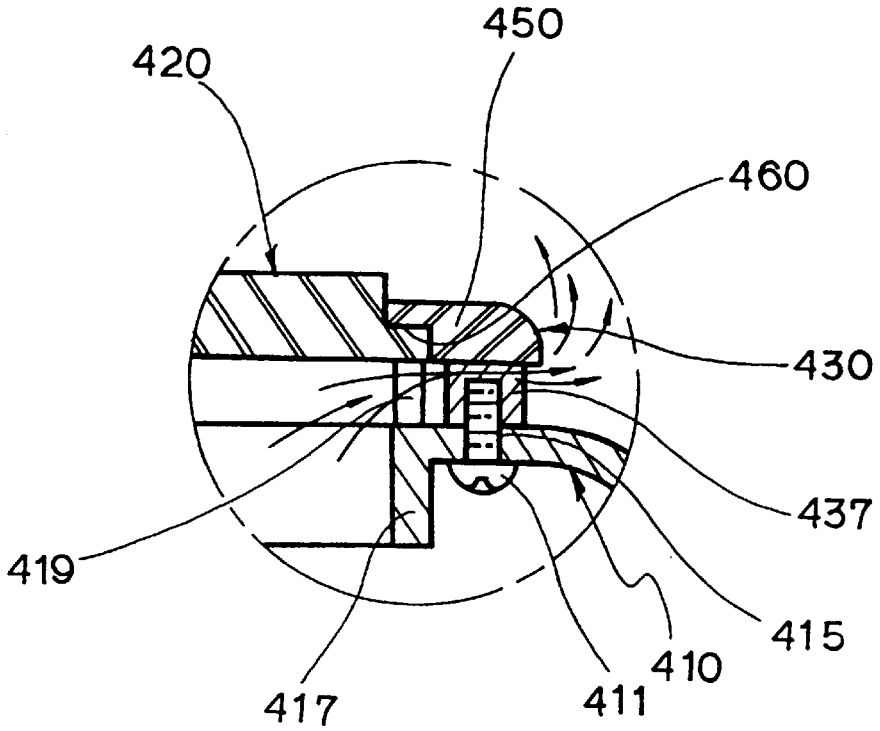
FIG. 14 is an enlarged sectional view partially illustrating a cover unit according to another embodiment of the present invention.

On the other hand, FIG. 14 is an enlarged sectional view partially illustrating a cover unit according to another embodiment of the present invention. Since the function of the cover unit in this embodiment is identical to that of the embodiment of FIG. 1, its detailed description will be omitted. Only the characterized configuration of the cover unit will be described hereinafter.

In accordance with this embodiment, an annular step 460 is provided at the peripheral edge of the heating plate 420. Another annular step 450 mating with the annular step 460 is provided at the inner peripheral edge of the holder 430. When the cover ring 410 and holder 430 are coupled together by means of the set screws 411 under the condition in which the heating plate 420 is laid on the support protrusions 419 of the cover ring 410, the annular step 450 of the holder 430 engages with the annular step 460 of the heating plate 420. Accordingly, the heating plate 420 is firmly supported between the cover ring 410 and holder 430.

Since the annular step 450 of the holder 430 engages with the annular step 460 of the heating plate 420 in accordance with this embodiment, there is no gap which may allow foreign matters to enter the interior of the burner unit 500, between the contact portions of the heating plate 420 and holder 430. Accordingly, the burner unit 500 is prevented from being contaminated by foreign matters.

Figure 15:
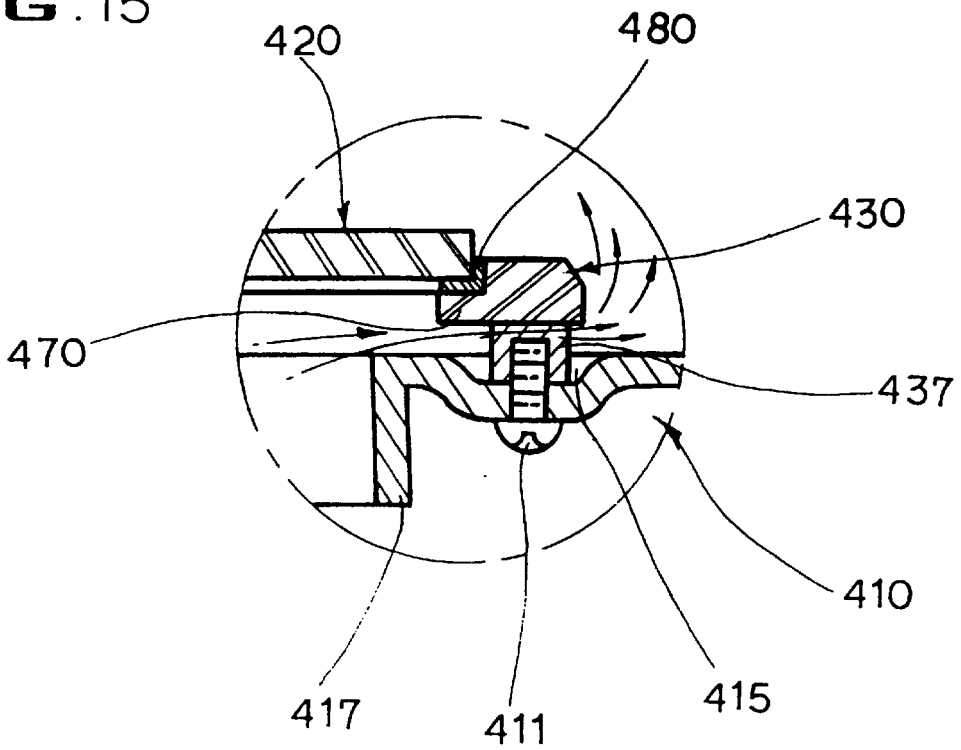
FIG. 15 is an enlarged sectional view partially illustrating a cover unit according to another embodiment of the present invention.
Figure 16:
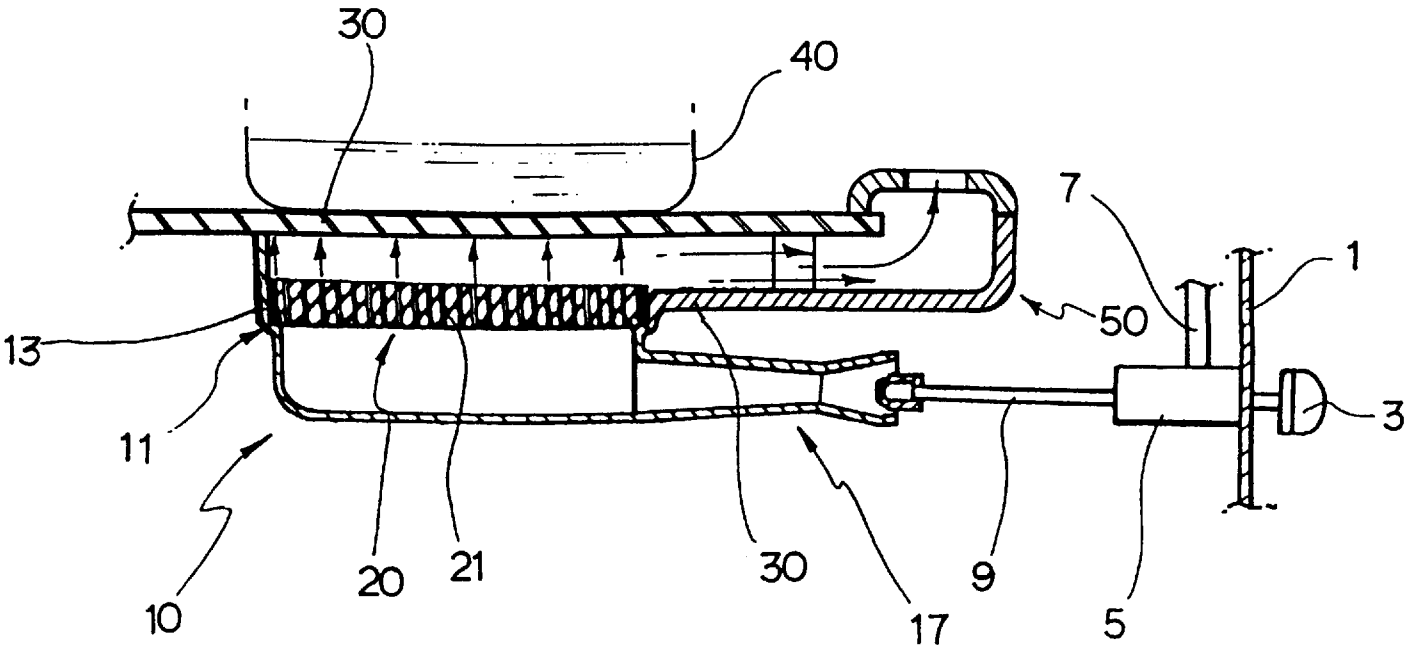
FIG.16 (PRIOR ART)
FIG. 16 is a sectional view schematically illustrating the construction of a conventional infrared gas burner for gas cookers.

FIG. 15 is an enlarged sectional view partially illustrating a cover unit according to another embodiment of the present invention. Since the function of the cover unit in this embodiment is identical to that of the embodiment of FIG. 1, its detailed description will be omitted. Only the characterized configuration of the cover unit will be described hereinafter.

In accordance with this embodiment, the cover ring 410 is only provided with a plurality of coupling holes 415 (at least three coupling holes). An annular step 470 is provided at the holder 430 to support the heating plate 420. A fixing means 480 made of silicon resin is attached to the annular step 470 of the holder 430. The heating plate 420 is supported at its peripheral edge on the fixing means 480.

The cover unit of this embodiment can be made using an easy and simple machining and assembling process because the heating plate 420 has no inclined surface such as the inclined surface 425 while the cover ring 410 has no support protrusion such as the support protrusion 419. Accordingly, an improvement in productivity is achieved.

As apparent from the above description, gas injected from the nozzle is mixed with air in an optimum state for its combustion by the mixing tube in accordance with the present invention. The mixing tube also serves to uniformly distribute the gas mixture throughout the flame holes of the ceramic plate by the mixing tube. The support member provides a double air layer which serves to reduce the transfer of heat to the body of the burner unit, thereby minimizing loss of heat to the outside of the burner. Since the metal net is disposed over the ceramic plate, an unburned portion of gas is burned again. Accordingly, it is possible to suppress the generation of noxious gas.

In accordance with the present invention, the user can set a desired cooking or heating temperature by manipulating the temperature control unit. Accordingly, a convenience in use is obtained. The temperature control unit can maintain the temperature of flames generated by the burner unit at a desired temperature where the burner is used for a long period. Accordingly, it is possible to optimize the consumption of gas, thereby obtaining a high combustion efficiency.

In accordance with the present invention, it is also possible to rapidly discharge exhaust gas generated in a small amount during the operation of the burner. During the discharge of the exhaust gas, heat of the exhaust gas is rapidly transferred to a cooking pot. Accordingly, the heating speed of the cooking pot increases, thereby achieving an improvement in the thermal efficiency of the burner. Thus, the infrared gas burner of the present invention has an improved efficiency and reliability.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An infrared gas burner for a gas cooker comprising:

a burner body;

a burner unit adapted to generate flames from gas supplied from a gas source and provided with a ceramic plate having a plurality of flame holes;

a gas valve connected between the gas source and the burner unit and adapted to adjust the amount of gas supplied from the gas source to the burner unit;

a knob attached to the burner body and adapted to control the gas valve;

a mixing tube arranged between the gas valve and the burner unit and adapted to mix gas supplied from the gas valve with air;

supporting means for supporting the ceramic plate within the burner unit in such a manner that the gas mixture emerging from the mixing tube passes through the flame holes of the ceramic plate;

a temperature control unit adapted to measure a temperature of flames generated when the gas mixture passing through the ceramic plate is ignited by an ignition unit, thereby controlling the amount of gas supplied to the burner unit based on the measured temperature; and a cover unit disposed over the burner unit and adapted to transfer infrared radiant heat and exhaust heat generated at the burner unit to a cooking pot laid thereon, wherein the supporting means comprises a support member having an upper portion fixedly mounted to an inner peripheral surface of the burner unit and an inwardly bent lower portion providing a seat for supporting the ceramic plate in such a manner that the ceramic plate is inwardly spaced apart from an inner peripheral surface of the burner unit while being surrounded by a packing contacting an inner surface of the lower portion of the support member.

2. An infrared gas burner for a gas cooker comprising:

a burner body;

a burner unit adapted to generate flames from gas supplied from a gas source and provided with a ceramic plate having a plurality of flame holes;

a gas valve connected between the gas source and the burner unit and adapted to adjust the amount of gas supplied from the gas source to the burner unit;

a knob attached to the burner body and adapted to control the gas valve;

a mixing tube arranged between the gas valve and the burner unit and adapted to mix gas supplied from the gas valve with air;

supporting means for supporting the ceramic plate within the burner unit in such a manner that the gas mixture emerging from the mixing tube passes through the flame holes of the ceramic plate;

a temperature control unit adapted to measure a temperature of flames generated when the gas mixture passing through the ceramic plate is ignited by an ignition unit, thereby controlling the amount of gas supplied to the burner unit based on the measured temperature; and a cover unit disposed over the burner unit and adapted to transfer infrared radiant heat and exhaust heat generated at the burner unit to a cooking pot laid thereon wherein the cover unit includes a cover ring disposed over the burner unit and provided with a flame opening, a heating plate supported on the cover ring, and a holder coupled to the cover ring by set screws in such a manner that the heating plate is firmly interposed between the cover ring and the holder.

3. The infrared gas burner in accordance with claim 2, wherein the mixing tube includes:

a nozzle provided with at least three gas injection ports, each having an axis extending perpendicularly with respect to the axis of the nozzle and tangentially with respect to the periphery of the nozzle and adapted to inject gas introduced from the gas valve through the gas injection port;

air inducting means adapted to mix the introduced air with the gas;

mixing means adapted to mix the introduced air with the gas;

diffusion means adapted to diffuse the gas mixture; and distribution means adapted to distribute the diffused gas mixture emerging from the distribution unit throughout the ceramic plate.

4. The infrared gas burner in accordance with claim 3, wherein the supporting means comprises a support member integrally formed with an upper body portion of the burner unit in such a manner that a step is formed, the support member having an annular protrusion formed on the step and an annular groove defined around the annular protrusion, whereby the support member supports the ceramic plate in such a manner that the ceramic plate is laid on the annular protrusion while being surrounded by a packing engaged in the annular groove.

5. The infrared gas burner in accordance with claim 3, wherein the supporting means comprises a support member integrally formed with an upper body portion of the burner unit in such a manner that a step is formed, the support member having a plurality of protrusions formed on the step.

6. The infrared gas burner in accordance with claim 2, wherein the cover ring of the cover unit has a plurality of support protrusions adapted to support the heating plate and a plurality of coupling holes for receiving the set screws, respectively.

7. The infrared gas burner in accordance with claim 6, wherein the heating plate of the cover unit has an inclined surface at a peripheral edge portion thereof.

8. The infrared gas burner in accordance with claim 1, wherein the heating plate of the cover unit has a step at a peripheral edge portion thereof.

9. The infrared gas burner in accordance with claim 1, wherein the holder of the cover unit is provided at an inner peripheral edge portion with an engaging rim engaging with the inclined surface of the heating plate and at a lower surface thereof with coupling protrusions respectively coupled with the set screws.

10. The infrared gas burner in accordance with claim 6, wherein the holder of the cover unit is provided at an inner peripheral edge portion thereof with a step engaging with the step of the heating plate.

11. The infrared gas burner in accordance with claim 7, wherein the holder of the cover unit is provided at an inner peripheral edge portion thereof with an annular step having fixing means made of silicon resin to support the heating plate.

12. The infrared gas burner in accordance with claim 2, wherein the cover ring of the cover unit has a plurality of exhaust nozzles arranged in a circle having a diameter larger than that of a circle on which the coupling holes are arranged.

* * * * *

UNITED STATES PATENT AND TRADEMARK OFFICE

CERTIFICATE OF CORRECTION

PATENT NO. : 5,816,235

DATED : OCTOBER 6, 1998

INVENTOR(S) : KIM ET AL.

It is certified that error appears in the above-identified patent and that said Letters Patent is hereby corrected as shown below:

Col. 14, line 29, claim 7: "claim 6" should read —claim 2—

Col. 14, line 32, claim 8: "claim 1" should read —claim 2—

Col. 14, line 35, claim 9: "claim 1" should read —claim 7—

Col. 14, line 41, claim 10: "claim 6" should read —claim 8—

Col. 14, line 45, claim 11: "claim 7" should read —claim 2—

Col. 14, line 50, claim 12: "claim 2" should read —claim 6—

Signed and Sealed this

Third Day of October, 2000

*Attest:*

Q. TODD DICKINSON

*Attesting Officer*

*Director of Patents and Trademarks*